United States Patent [19]

Hirabayashi et al.

[11] Patent Number: 4,937,634

[45] Date of Patent: Jun. 26, 1990

[54] REPRODUCING MACHINE WITH DOCUMENT FEEDING APPARATUS

[75] Inventors: Tsugio Hirabayashi; Yasushi Yamada; Yoshikazu Maekawa, all of Tokyo, Japan

[73] Assignee: Konica Corporation, Tokyo, Japan

[21] Appl. No.: 192,291

[22] Filed: May 2, 1988

[30] Foreign Application Priority Data

May 12, 1987 [JP] Japan ..... 62-115324

[51] Int. Cl.[5] ..... G03G 21/00

[52] U.S. Cl. ..... 355/309; 271/270; 355/313

[58] Field of Search ..... 355/14 SH, 3 SH, 23, 355/24; 271/3.1, 202, 270, 291

[56] References Cited

U.S. PATENT DOCUMENTS 4,179,215 12/1979 Hage ..... 355/318 X
4,412,740 11/1983 Buddendeck et al. ..... 355/3 SH X
4,508,447 4/1985 Doery ..... 355/14 SH
4,526,361 7/1985 DuBois ..... 271/270 X
4,579,327 4/1986 Furuichi ..... 271/202 X
4,634,263 1/1987 Miwa ..... 355/14 SH

*Primary Examiner*—A. T. Grimley
*Assistant Examiner*—Robert Beatty
*Attorney, Agent, or Firm*—Nilles & Nilles

[57] ABSTRACT

A reproducing machine with a document feeding apparatus in which a document on a document stacker can be fed repeatedly after it is returned to the document stacker through a document feeding portion and a processing unit, and a feeding speed of the document can be varied by a control device. The feeding speed of the document when a single copy is required and the feeding speed of the document in a first cycle of copying when plural copies are required are set slower than that of the document in following cycles when plural copies are required in which the speed is set to a value as high as the processing power of the reproduction machine.

3 Claims, 5 Drawing Sheets

REPRODUCING MACHINE WITH DOCUMENT FEEDING APPARATUS

BACKGROUND OF THE INVENTION

1. Field of the Invention

The present invention relates to a reproducing machine having a document feeding apparatus and an exposure processing portion wherein documents in a document bundle stacked on a document stacker are fed one by one to a document glass plate and, after an exposing process, they are returned to the document stacker, and the steps of feeding and returning of the documents are repeated at every circulation of the documents bundle, so that a single copy of the documents can be obtained at every circulation of the document bundle.

2. Description of the Prior Art

Generally speaking, some reproducing machines of this kind have no sorting apparatus, so that in case the number of documents is large and the copy number is also large, the production capacity or power of the machine is limited. In order to increase the power or production capacity it is necessary to increase the copy speed of the reproducing machine and to enhance the document changing speed of the document feeding apparatus as high as the processing power of the reproducing machine permits.

If the copy speed of the reproducing machine is increased, however, the feeding speed of the copy paper must inevitably be increased. In case that the processing power or production capacity of the reproducing machine is 70 cpm, for example, a processing speed of more than 400 mm/sec is required. In a paper feeding system for feeding copy papers one by one at every single copy cycle in which a document sheet is fed from the document stacker through the exposure processing portion and returned to the document stacker in order to meet the above requirement, the feeding speed of the copy paper becomes 1,000 mm/sec, and damage to the copy paper, an increase of the driving sound and a reduction of reliability can be expected.

Accordingly, in case that the copy speed of the reproducing machine is increased, it is necessary to set the feeding speed of the copy paper similar to said processing speed (400 mm/sec). If the feeding speed is set as above, a plurality of copy papers always remain in the feeding path of copying paper. Accordingly, if the copy of two sheets document is finished by one cycle, for example, it is enough to feed two sheets of copy paper. However, if the document feeding speed (document exchanging speed) of the document feeding apparatus is enhanced to a value as high as the production capacity of the reproducing machine, a copy paper for the document following the said two document sheets is also fed in the paper feeding path of the copy paper and remains in the paper feeding path after the copying operation has been finished, which would make trouble.

SUMMARY OF THE INVENTION

An object of the present invention is to solve the problems thus far described and to provide a reproducing machine with a document feeding apparatus wherein no copy paper remains in a paper feeding path while maintaining a document exchanging speed at a value at which the maximum processing power or production capacity of the reproducing machine can be made.

Another object of the present invention is to provide a reproducing machine with a document feeding apparatus wherein a document on a document stacker can be fed repeatedly after it is returned to the document stacker through a document feeding portion and a processing portion, and wherein control means for varying a feeding speed of the document is provided so that a feeding speed of the document is controlled according to the copy number. A further object of the present invention is to provide a reproducing machine with a document feeding apparatus wherein, in case that a single copy is required, a feeding speed of the document is set slower so that one sheet of copy paper is fed at every copy cycle, but in case that plural copies are required, the feeding speed of the document is set to a proper value of the processing power of the reproducing machine after the sheet number of the documents is detected (at which all documents have been circulated). Another object of the present invention is to provide a reproducing apparatus wherein, in case that plural copies are required, an exchange speed of the documents of the document feeding apparatus is set initially to a value as high as the processing power of the reproducing machine, because, in case that the documents are circulated more than one time, the sheet number of the documents can be detected by the first circulation and because a copy paper failed to be delivered because of fluttering can be used for a first sheet of the documents in the second circulation.

Other objects and features of the present invention will become apparent from the following description taken with reference to the accompanying drawings.

BRIEF DESCRIPTION OF THE DRAWINGS

FIGS. 4(A) and 4(B) are elevation views, partly in section, showing the two operating states of the gate member;

FIGS. 8(A) and 8(B) are schematic views showing the two operating states of the rotation control means of FIG. 7;

FIGS. 9(A) and 9(B) are schematic views showing the operating states of a push belt (or semicircular roller);

FIG. 10 is a perspective view showing the drive system of a conveyor belt;

FIG. 11 is a perspective view showing the actuating mechanism of a document stopper;

FIG. 14 is a schematic view showing a control system.

DESCRIPTION OF THE PREFERRED EMBODIMENTS

Figure 1:
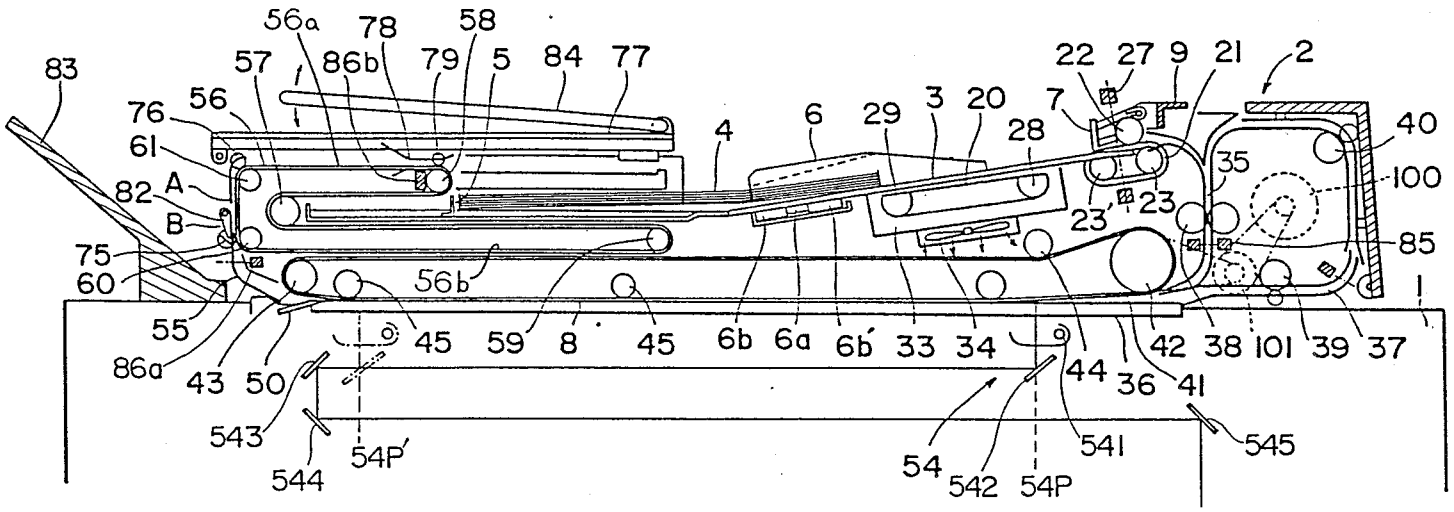
FIG. 1 is a sectional front elevation view showing a document feeding apparatus.

In FIG. 1, reference numeral 1 designates a reproducing machine which can select between two copy modes and having an exposing optical system capable of moving and of being fixed. Numeral 2 designates a document feeding apparatus. This document feeding apparatus 2 is equipped with a document stacker 3 having its front portion rising upward. On this document stacker 3, there are mounted a rear end regulating member 5, by which are regulated the rear ends of documents 4 when the latter are to be set, and transverse width regulating plates 6 and 6' (FIG. 12) for regulating the widths of the documents 4. The amount of movement of the rear end regulating member 5 differs according to the length of the document and is detected by means of a moving amount detecting sensor 501, as shown in FIG. 14. The transverse width regulating plates 6 and 6' are in meshing engagement, at the lower side of the document stacker 3, with racks 6*b* and 6*b*' which can transversely slide alternately across a pinion gear 6*a* so that they can move symmetrically with respect to the center. The transverse size of the documents can be read out by detecting the position of the regulating plates 6 and 6' by means of a position detecting sensor 601, as shown in FIG. 14, because regulating plates 6 and 6' are moved by hand so as to be in accord with the transverse width of the document. On the other hand, the aforementioned rear end regulating member 5 functions to push the leading ends of the documents 4, which are set on the document stacker 3, to the (fixed) detection position of a stack sensor 27.

Figure 3:
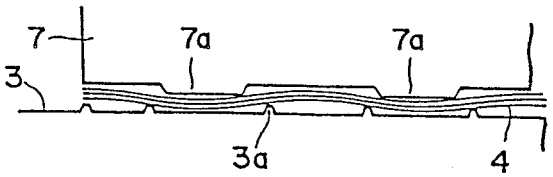
FIG. 3 is a schematic view showing a deformed state of documents pushed onto a document stacker by a gate member.
Figure 2:
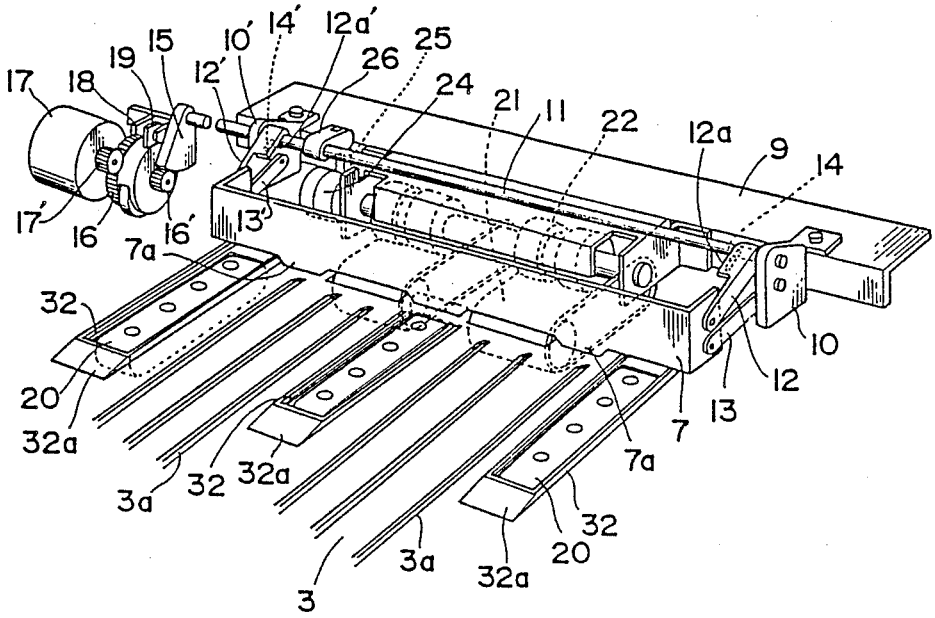
FIG. 2 is a perspective view showing a document stacker and a paper feed means.

Reference numeral 7 designates a gate member which assumes an upper position, when the documents 4 are pushed forward by the action of the aforementioned rear end regulating member 5, and which is moved downward onto the documents 4 by its own weight or by a spring in response to a signal from said stack sensor 27 when the leading ends of the documents reach the detection position of the stack sensor 27. The gate member 7 functions to hold the documents 4 to be fed by its own weight and to abut against the leading ends of the documents, which have made one circulation through a processing portion 8 and have returned onto the document stacker 3, as will be described hereinafter, thereby to arrange the leading ends for a subsequent feed and to discriminate the restacked documents from the documents being fed. Thus, in order to provide those functions effectively, according to the present embodiment, the document stacker 3 is provided on its upper surface with ribs 3*a* which extend for a suitable distance in the paper feeding direction, as shown in FIG. 2, and the gate member 7 is provided at its lower end edge with a plurality of projections 7*a* which correspond to the intervals between the ribs 3*a* in the form of the so-called "comb teeth". In other words, the documents on their stacker 3 are undulated, as shown in FIG. 3, by the ribs 3*a* and the comb-toothed projections 7*a* to give a firmness to the documents 4 being fed and to effectively prevent the leading ends of the returned documents (processed documents) from sinking below the gate.

The aforementioned gate member 7 is formed generally in the shape of letter "C", as viewed in top plan, and has its two sides pivotally supported, as shown in FIG. 2, by both the leading ends of right and left gate levers 12 and 12', which having their base end portions fitted loosely on a shaft 11 rotatably mounted on upper portions of brackets 10 and 10' fixed on a front frame 9 of the document feeding apparatus 2 by means of screws or the like, and the leading ends of auxiliary levers 13 and 13' which have their base end portions rotatably mounted in the lower sides of the brackets 10 and 10'. The gate levers 12 and 12' are provided at the upper portions of their inner edges with extentions 12*a* and 12*a*' having lower sides, against which abut push-up pins 14 and 14' implanted in the aforementioned shaft 11. This shaft 11 has fixed thereon at its end portion a sector wheel 15, which meshes with a small gear 16' aligned with a gate cam gear 16. This gate cam gear 16 in turn meshes with an output gear 17' of a reversible drive source 17. As a result, when the shaft 11 is rotated clockwise by the drive of the gate drive source 17, the aforementioned push-up pins 14 and 14' turn upward the gate levers 12 and 12' through their extensions 12*a* and 12*a*' to lift the gate member 7, as shown in FIG. 4(A). In this lifted position of the gate member 7, on the other hand, if the aforementioned shaft 11 is rotated counterclockwise by the drive of the gate drive source 17, the push-up pins 14 and 14' and the gate levers 12 and 12' riding on the former are turned downward to lower the gate member 7, as shown in FIG. 4(B). At this time, the push-up pins 14 and 14' are allowed to relieve more than the angle at which the gate member 7 abuts against the documents on the document stacker 3. This causes the gate member 7 to hold the documents on the stacker by its own weight or by spring action. Since the gate member 7 is followed by the aforementioned auxiliary levers 13 and 13' while it is moving up and down, its front face is kept in a generally normal position with respect to the upper surface of the document stacker 3. In other words, the gate member 7 is enabled to ride on the documents while having its front face normal to the document surface independently of the number of documents.

The aforementioned gate cam gear 16 is provided with a tongue 19 for shielding a sensor 18 for detecting the initial position thereof. This sensor 18 establishes a home position for the gate cam gear 16 when it is shielded with the tongue 19 so that it can rotate forward and backward the aforementioned drive source 17 by a necessary angle. This drive source 17 to be used in this case is preferably a pulse-controllable stepping motor.

Reference numeral 20 designates a push-out belt for pushing out the documents from the predetermined position to the paper feed position. Numeral 21 designates a paper feeding belt for feeding out the documents in the paper feed position with the lowermost one first. Numeral 22 designates a stop roller contacting the paper feeding belt 21 for preventing any overlapped feed of the documents. The paper feeding belt 21 is made to run under tension between a drive shaft 23, which is connected to a main motor 100 through both an electromagnetic clutch 21*a* mounted on the drive shaft 23 and a one-way control means not-shown, and a driven shaft 23' is adapted to have its upper surface raised slightly from the ribs 3*a* of the document stacker 3.

Figure 5:
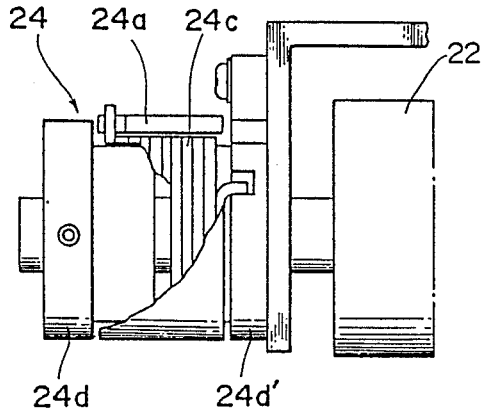
FIG. 5 is a partially cutaway front elevation view showing a spring clutch fixed on a stopper roller shaft.
Figure 6:
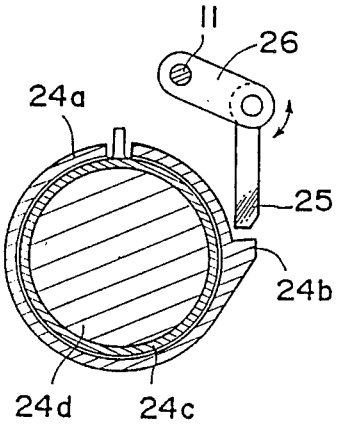
FIG. 6 is a sectional side elevation view of the clutch of FIG. 5.

On the shaft of the aforementioned stop roller 22, there is mounted a spring clutch 24. This spring clutch 24 is enabled, as shown in FIGS. 5 and 6, to relieve its spring 24*c* from spring bosses 24*d* and 24*d*' thereby to bring the stop roller 22 into a freely rotatable state (for driven rotations) by pushing downward a projection 24b of a sleeve 24a by a clutch lever 25, and to regulate the rotations of the stop roller 22 when the clutch lever 25 exerts no action upon the projection 24b of the sleeve 24a. That clutch lever 25 is pivotally mounted in a position depending on the leading end of an arm 26 which, in turn, is fixed on the aforementioned shaft 11 in an opposite direction to that of the push-up pin 14 of the aforementioned gate lever. As a result, when the gate member 7 is lifted through the pin 14 by the rotations of the shaft 11, as shown in FIG. 4(A), the aforementioned clutch lever 25 is moved downward to push the projection 24b of the clutch 24 clockwise. When, on the other hand, the gate member 7 is moved downward to ride onto the documents 4 by the reverse rotations of the shaft 11, as shown in FIG. 4(B), the clutch lever 25 is brought upward apart from the projection 24b of the spring clutch 24 so that this spring clutch 24 is caused to restore its initial position by the action of its built-in spring thereby to regulate the rotations of the aforementioned stop roller 22.

The aforementioned push-out belt 20 is made of a molded material, which is made to run under tension between the so-called "semicircular rollers" 28 and 29 having their outer circumferences partially cut away, and has air holes 20' therein to suck the lower sheet by means of a suction fan 34. Of the semicircular rollers, one roller 28 receives the driving force from the main motor 100 through a one-rotation spring clutch 30, as shown in FIG. 7, like the aforementioned paper feeding belt 21.

Figure 7:
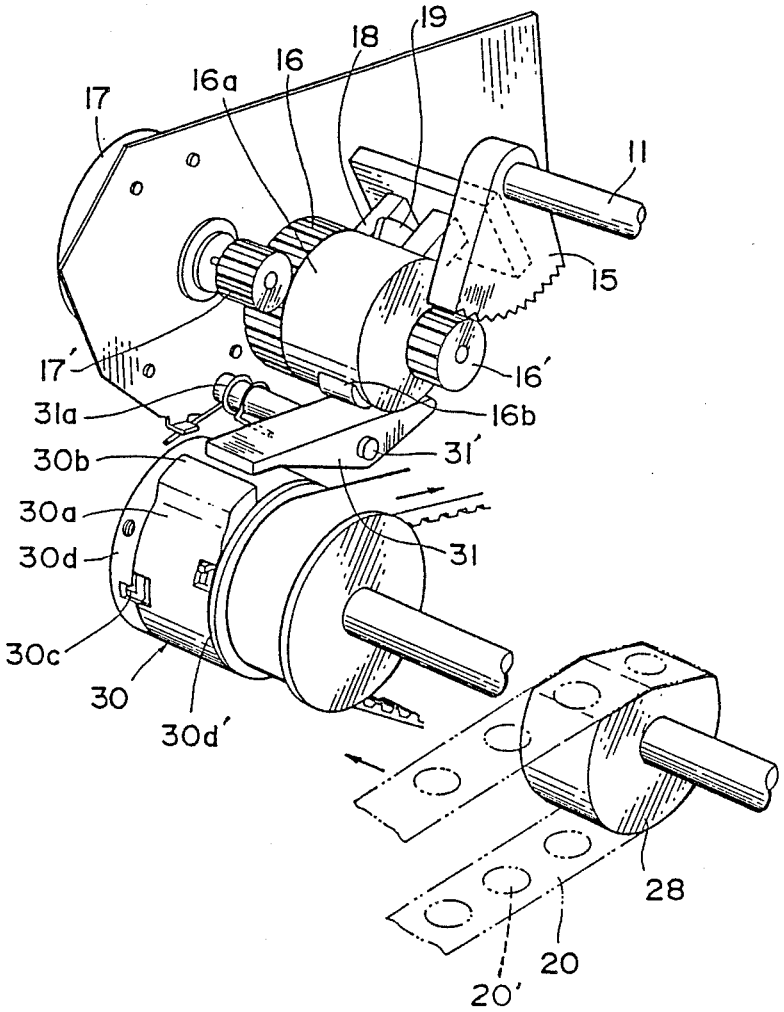
FIG. 7 is a perspective view showing one rotation control means of a semicircular roller.

The one-rotation spring clutch 30 has its built-in clutch spring 30c loosened from spring bosses 30d and 30d' (as shown in FIG. 7) so that it is isolated from the driving force of the main motor 100, while a sleeve 30a has its projection 30b abutting against the leading end of a clutch lever 31 made movable up and down like a seesaw on a support 31', as shown in FIG. 8(A), so that its rotations are regulated. When, on the other hand, the leading end of the clutch lever 31 goes out of engagement with the projection 30b of the sleeve 30a of the spring clutch 30, as shown in FIG. 8(B), the clutch spring 30c fastens the spring bosses 30d and 30d' so that the driving force of the main motor 100 is transmitted to the semicircular roller 28.

The rear end of the aforementioned clutch lever 31 is forced into contact with the cylindrical portion 16a of the aforementioned gate cam gear 16 by the action of a tension spring 31a. The cylindrical portion 16a is provided with a cam-shaped land 16b on a portion of its circumference. As a result, when the gate cam gear 16 is rotated by the action of the drive source 17 of the gate member 7 to have its cam-shaped land 16b push down the rear end of the clutch lever 31, the leading end of this clutch lever 31 goes out of engagement with the projection 30b of the sleeve 30a of the spring clutch 30. The rocking motions of this clutch lever 31 are accomplished within such a rotational region of the gate cam gear 16 as is independent of the upward and downward drives of the gate member 7 during the downward movement of said gate member 7. In other words, the gate cam gear 16 has a home position (as indicated at reference letter P in FIGS. 8(A)), which is determined by the initial position detection sensor 18 and the tongue 19, as has been described hereinbefore. The rotational region $S_1$, which is taken counterclockwise from that home position P, is used for moving the gate member 7 upward and downward, whereas the rotational region $S_2$ taken clockwise is used for locking the clutch lever 31.

Within the rotational region $S_2$ of the gate cam gear 16, specifically, the stepping motor acting as the aforementioned drive source 17 rotates clockwise from the above-specified point P to an extent corresponding to a constant number of pulses and then counterclockwise by the same number of pulses.

Here, in the rotational region $S_2$ of the gate cam gear 16 to be used for those rocking motions, the push-up pin 14 escapes from the gate lever 12, and the sector wheel 15 will skip to the small gear 16' at its tooth end.

When the leading end of the clutch lever 31 goes out of engagement from the projection 30b of the sleeve 30a, as has been described hereinbefore, so that the rotations of the semicircular roller 28 are started by the main motor, the gate cam gear 16 is rotated counterclockwise by the backward rotations of the gate driving source 17 so that the rear end of the clutch lever 31 is disengaged from the camshaped land 16b and returned by the spring 31a to a position close to the sleeve 30a of the spring clutch 30 which has been passed at its leading end by the projection 30b. This projection of the sleeve 30a of the spring clutch, which has accomplished one rotation following the semicircular roller 28, comes again into abutment against the leading end of the clutch lever 31 to effect isolation of the driving force of the main motor 100. Thus, the semicircular roller 28 never fails to halt after each one rotation.

On the other hand, the aforementioned push-out belt 20 is disposed, as shown in FIG. 2, in each of the apertures 32 which are juxtaposed to one another in a plurality of positions (e.g., in three positions, as shown) over the document stacker 3. Each aperture 32 has its peripheral edge rising to the same level as that of the ribs 3a of the document stacker 3 and sloped upstream of the paper feeding direction, as indicated at 32a, so that the leading ends of the documents may not be caught. Moreover, the upper belt surface will sink below the aperture 32, as shown in FIG. 9(A), when the semicircular roller 28 or 29 rotates to bring its cut-away portion up, but will bulge, as shown in FIG. 9(B), when the semicircular portion of the semicircular roller 28 or 29 is brought up. Specifically, the documents 4 in the fixed position on the document stacker 3 are frictionally pushed out by the push-out belts 20 bulging from the apertures 32 as the semicircular rollers 28 and 29 make one rotation. Since, in this case, the paper feeding belt 21 is halted because the power of the main motor 100 is interrupted by the action of the electromagnetic clutch 21a, the leading ends of the documents pushed out will bite in the form of a wedge into the nipping (or loosening) portion between the paper feeding belt 21 and the stop roller 22.

Reference numeral 33 designates a suction box which is disposed to surround each of the aforementioned push-out belts 20 from the lower side of the document stacker 3. The suction box 33 is enabled by the sucking action of its suction fan 34 to suck the lowermost one sheet of the documents through the clearance between the aforementioned aperture 32 and the push-out belt 20 and through the belt holes 20' so that the pushing-out force of the push-out belt 20 may be effectively exhibited.

Numeral 35 designates a forward passage for guiding the documents fed out by the aforementioned paper feeding means onto the platen glass plate 36 of the reproducing machine 1 acting as the processing portion 8. Numeral 37 designates a turning passage for turning the documents once fed onto said platen glass plate 36 before or after the exposure. This turning passage 37 is provided for correcting the turns of the even-numbered pages of two-sided documents toward the platen glass plate 36 and the sequence of the pages when the documents thus corrected and exposed are to be returned to the document stacker 3. Thus, the turning passage 37 merges into the upper portion of the aforementioned forward passage 35 after it has drawn an upward loop from the same plane as that of the aforementioned platen glass plate 36.

Numeral 38 designates a conveyor roller which is disposed midway of the aforementioned forward passage 35, whereas numerals 39 and 40 designate conveyor rollers which are disposed midway of the aforementioned turning passage 37. These conveyor rollers 38, 39 and 40 are so connected to the main motor 100 through one-way control means that they can rotate in the same feeding direction at all times.

Numeral 41 designates a conveyor belt for conveying the documents forward and backward on the upper surface of the platen glass plate 36. This conveyor belt 41 is made to run under tension between a first roller 42 connected at the feed side to the main motor 100 through forward/backward switching means 101 and a second roller 43 at the discharge side. A tension roller 44 is forced into contact with the upper belt surface near the first roller 42, and the lower belt surface is held in sliding contact with the platen glass plate 36 by a plurality of holding rollers 45.

The first roller 42 and second roller 43 described above are connected to each other through a timing belt 46, as shown in FIG. 10. In this connection, a timing pulley 47 located at the side of the first roller 42 is fixed on a first roller shaft 42*a*, and a timing pulley 48 located at the side of the second roller 43 is fixed on a second roller shaft 43*a* through a one-way clutch 49. Moreover, the circumferential speed of the first roller 42 is made slightly higher than that of the second roller 43 which is driven through the one-way clutch 49. As a result, the conveyor belt 41 is run in the forward direction (as indicated by arrow in FIG. 10) by the driving force of the first roller 42 to loosen the lower belt surface. Meanwhile, the second roller 43 is sliding through the one-way clutch 49 but is enabled to act as a drive side to drive the conveyor belt 41 by the action of the one-way clutch 49 which is locked when the conveyor belt 41 slips relative to the first roller 42, for example, by some cause so that its driving force is not fully transmitted to lower the running speed. When, on the contrary, the conveyor belt 41 is run in the opposite (i.e., counterclockwise) direction, the one-way clutch 49 is locked so that the second roller 43 acts as the drive side of the conveyor belt 41. In other words, the conveyor belt 41 can run with the drive side of either the first roller 42 or the second roller 43. This switching is effective especially when the documents are synchronously exposed while being fed on the platen glass plate.

Reference numeral 50 designates a document stopper which is disposed at the end portion of the platen glass plate 36 at the discharge side. As shown in FIG. 11, this stopper 50 is supported at its central portion through a connection pin 52 by one end of an actuating lever 51, which can rock like a seesaw, and is enabled to approach or retract from the platen glass plate 36 by the action of a solenoid 53 connected to the other end of the actuating lever 51 by a link 53*a* and a spring 51' facing the solenoid 53. The document stopper 50 thus constructed sinks from the platen glass plate 36 in the RDF mode, i.e., in the case the documents are exposed, while being conveyed at a synchronous exposure speed over the platen glass plate 36 by the conveyor belt 41, to form an image on a drum with an exposing optical system 54 being fixed, which is enabled to have its modes selected between a fixed mode positioned just below the platen glass plate 36 and a moving mode. In the ADF or SDF mode, on the other hand, in the case the documents are halted in the exposure position on the platen glass plate 36 so that they may be exposed to form an image on the drum with the optical system 54 being moved, the document stopper 50 bulges above the platen glass plate 36.

Numeral 55 designates a paper discharge guide plate which extends to the exit of the platen glass plate 36, and numeral 56 designates a discharge belt. This discharge belt 56 is so made to run under tension on a set of rollers: a drive roller 57 mounted just behind the document stacker 3 and connected to the main motor 100 through one-way control means; upper and lower end rollers 58 and 59 mounted to move horizontally along the upper and lower surfaces of the document stacker 3; and auxiliary rollers 60 and 61 mounted in the vicinity of the aforementioned paper discharge guide plate 55, so as to surround the rear side of the document stacker 3 in the shape of the letter "C". The discharge belt 56 thus constructed is enabled to convey in the discharging direction the documents which are fed out of the conveyor belt 41 as the aforementioned drive roller 57 rotates in a predetermined direction.

Figure 12:
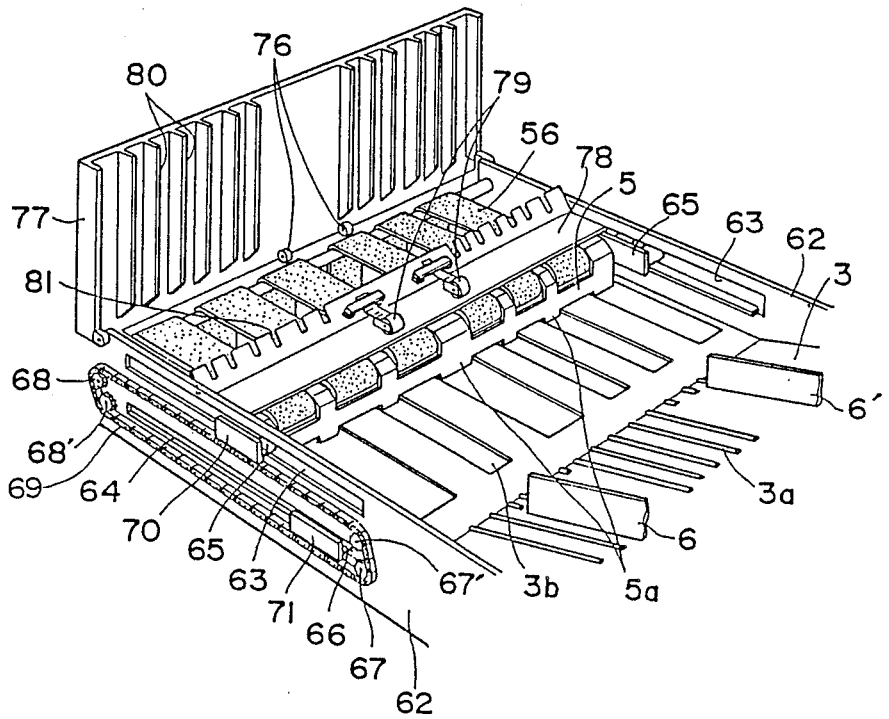
FIG. 12 is a perspective view showing the rear side of a document stacker.
Figure 13:
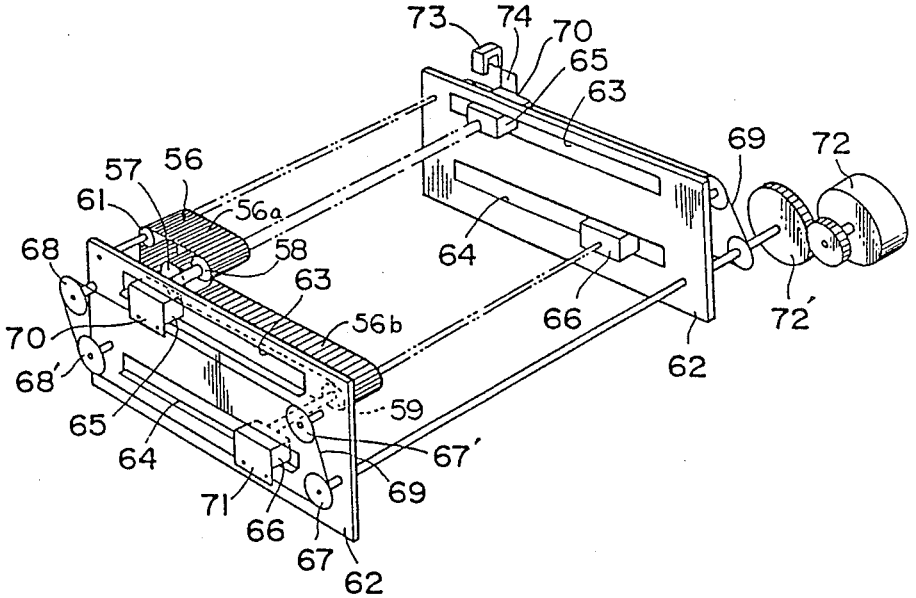
FIG. 13 is a schematic perspective view showing a drive means of a paper discharge belt and a rear end regulating member.

The upper and lower end rollers 58 and 59 of the paper discharging belt 56 are mounted, as shown in FIG. 12, between upper moving members 65 and lower moving members 66, respectively, which are held in a sliding manner through roller members in two parallel horizontal grooves 63 and 64 formed in the two side frames 62 of the document feeding apparatus 2. The respective moving members 65 and 66 are coupled through attachments 70 and 71 to the upper and lower sides of chains or wire 69 which are made to run under tension on two sprockets or wire pulleys 67 and 67' and two sprockets 68 and 68' mounted in the front and back of the aforementioned two side frames 62. Moreover, the sprocket 67 located at the lower side of the front portion is connected through an intermediate gear 72' to an reversible chain drive source 72, as shown in FIG. 13. As a result, when the chain drive source 72 runs the chains 69 forward or backward, the belt portion 56*a* located over the document stacker 3 moves forward or backward together with the upper end roller 58 which is mounted on the upper moving member 65 whereas the lower belt portion 56*b* moves backward or forward together with the lower end roller 59 borne on the lower moving member 66 so that the belt tension can always be maintained at a constant level.

The moving means of the paper discharging belt 56 is constructed as the movement control means of the aforementioned rear end regulating member 5 against which the documents have their rear ends abutting when they are to be set on their stacker 3. The rear end regulating member 5 is so fixed to the aforementioned upper moving members 65 as to cover the front of the upper end roller 58.

Accordingly, when the chain drive source 72 is so driven that the upper moving members 65 are moved forwards after the document has been set on the document stacker 3 so as to abut against the rear end regulating plate 5, the rear end regulating plate 5 is moved forwards while pushing out the documents.

The rear end regulating member 5 is provided, as shown in FIG. 12, at its lower end edge with extensions 5*a* which can be fitted in the shallow recesses 3*b* formed in parallel with the paper feeding direction in the upper surface of the rear portion of the document stacker 3 so that the documents to be pushed out may not sink below the rear end regulating member 5.

In FIG. 13, reference numeral 73 designates a home position sensor for the rear end regulating member 5. This sensor 73 defines as the home position of the rear end regulating member 5 the position, in which it detects a shielding member 74 mounted on the attachment 70 connected to the upper portion of the aforementioned chain 69. This home position determined the position, against which the rear end of the documents of a maximum size (e.g., the A3 size) can abut.

The aforementioned rear end regulating plate 5 moves forward from the starting point of a home position, as indicated by 5P in FIG. 14. When the leading end of the documents 4 pushed out by the regulating plate 5 is detected by the stack sensor 27, this detection signal is received by a control unit 721. Then, this control unit 721 halts the chain driving source 72 and retracts the rear end regulating plate 5 to forward points $5P_1$, $5P_2$, . . . , and $5P_n$ (which are shifted according to the size of the documents). In this case, the rear end regulating plate 5 may be retracted all the way to the home position. In the present embodiment, however, the regulating plate 5 is retracted from the front of the gate member 7 by a distance required by that size of the documents of interest which is defined by the detected value detected by the moving amount detecting sensor 501 of the rear end regulating plate 5 (i.e., the length of the documents in the feeding direction). In other words, the rear end regulating plate 5 is retracted by a distance equivalent substantially to the extent over which the leading end of the documents passes under the gate member 7, so that its advance may be minimized when the documents having made one circulation are fed again.

Reference numerals 75 and 76 designate holding rollers which are disposed in positions corresponding to the aforementioned auxiliary rollers 60 and 61 and in abutment against the paper discharging belt 56 from the outside of the paper discharging guide plate 55 through the aperture. Numeral 77 designates a ceiling guide plate which has its base end hinged to the upper portions of the rear ends of the two side frames 62 of the document feeding apparatus 2. Numeral 78 designates a discharge aperture guide plate which is disposed to face the upper moving members 65 bearing the aforementioned upper end rollers 58 at a small clearance from the upper surface of the upper belt portion of the paper discharging belt 56. Numeral 79 designates a holding roller which is in abutment against the paper discharging belt 56 through the aperture from the upper surface of said paper discharging aperture guide plate 78. The aforementioned ceiling guide plate 77 has its lower face serving as a guide surface provided with a plurality of ribs 80 arranged in the discharging direction to orient the documents. On these ribs 80, there are telescopically fitted notches 81 which are formed in the upper edge of the upward sloped rear plate of the paper discharging guide plate 78 so that the documents having advanced on the guide surface of the ceiling guide plate 77 may be guided without fail between the guide plate 78 and the paper discharging belt 56.

Numeral 82 designates a switching pawl which is disposed midway of the aforementioned paper discharging guide plate 55 for switching the processed documents between a circulating discharge passage A directed toward the document stacker 3 and an external discharge passage B directed to a paper tray 83 outside of the machine. This switching pawl 82 is made movable to open the external discharge passage B, when the aforementioned rear end regulating member 5 is returned to the home position, and the circulating discharge passage A when the rear end regulating member 5 is not in the home position. This switching action may be accomplished by using either a solenoid or another suitable mechanical means.

Reference numeral 84 designates a manual insertion plate which has its base end hinged to the upper surface of the leading end of the aforementioned ceiling guide plate 77. This manual insertion plate 84 is usually folded on the upper surface of the ceiling guide plate 77, as shown in FIG. 1. When the documents are fed one by one in the SDF mode, the manual insertion plate 84 can be extended on its hinged portion to cover the document stacker 3. Upon this extension, the leading end of the manual insertion plate 84 approaches the paper feeding belt 21. Moreover, the manual insertion plate 84 is so marked on its extended upper surface as to indicate the size of the documents to be fed so that the user can acknowledge the document insertion position. When the manual insertion plate 84 is extended, still moreover, a not-shown SDF actuator not-shown may advantageously be turned on. Reference numeral 86*a* in FIG. 1 denotes a first paper discharging sensor for detecting the final page of the documents.

Figure 15:
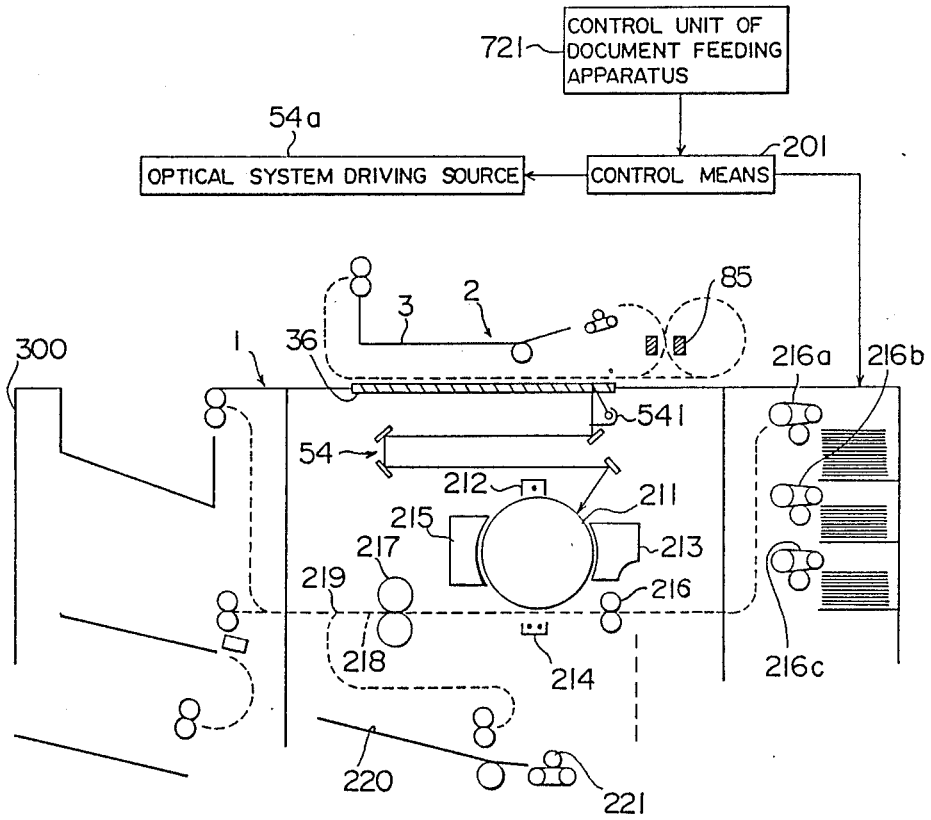
FIG. 15 is a schematic view showing the reproducing machine and a control system thereof.

In said reproducing machine 1, as shown in FIG. 15, a document fed from the document stacker 3 of the document feeding apparatus 2 to the platen glass plate 36 through the forward passage 35 is exposed with a light from a light source 541, movable between positions 54P and 54P' shown in FIG. 1, of the exposure optical system 54 and a reflected light is applied on a photosensitive drum 211 through mirrors 542, 543, 544 and 545. Mirror 542 is movable with light source 541. Around the photosensitive drum 211 are arranged a charging device 212, developing device 213, transfer device 214, cleaning box 215, paper feeding device 216 for feeding a copy paper between the photosensitive drum 211 and the transfer device 214, and fixing device 217 for fixing the toner image after the transfer. In case of one-side copying operation, a copy paper on which a document information has been transferred is fed to a final processing unit 300 through the fixing device 217. If a copying operation of the other side of the copy paper is required in this case (two-side copying) after the one-side copying operation has been completed, the copy paper is fed from a branch point 219 provided on the midway of a passage 218 going toward said final processing unit 300 to a copy paper stacker 220 mounted below the photosensitive drum 211 so that a surface to be copied faces upwards. The one-side copied paper on the copy paper stacker 220 is fed from the bottom thereof by a paper feeding device 221 to the transfer device 214 in such a way that the other side of the paper which has not yet been copied faces the photosensitive drum 211 and is then fed to the final processing unit 300 through the fixing device 217 after the two-side copying operation has been finished. The detail of the final processing unit 300 is not shown in the drawings. However, means for forming staple holes for filing on the bundle of the copy sheets and means for stapling by a stapler are understood to be provided therein.

Said reproducing machine 1 is provided with control means 201 for controlling a drive source 54*a* of the exposing optical system 54 according to the feed timing of the document in the document feeding apparatus 2, and for controlling the feed of the copy paper fed from the paper feeding device 216 to the transfer device 214 according to the timing of image formation on the photosensitive drum 211. In this case, selected and fed from paper feeding devices 216*a*-216*c* by instructions from the control unit 721 of the document feeding apparatus 2 is a copy paper of a size corresponding to detected values of a position detecting sensor (document width detecting means) 601 of the transverse width regulating plates 6 and 6' on the document stacker of the document feeding apparatus 2 and of a moving amount detecting sensor (document length detecting means) 501 of the rear end regulating member 5 (a larger size if both detected values are different from each other).

The control unit 721 of said document feeding apparatus 2 changes the feeding speed of the document (document exchange speed) according to a required copy number. In case of one sheet copying, for example, the copy papers are fed one by one at every copy cycle to the transfer device 214 from the paper feeding device 216 which is controlled by the control means 201 of the reproducing machine 1 by setting the speed as slowly as 40 cpm, if the processing power of the reproducing machine 1 is 70 cpm, for preventing the copy paper from fluttering while the copy paper is in the paper feeding path.

On the other hand, in case of plural sheet copying, the feeding speed of the document in a first cycle is controlled and fed slower by the control unit 721 of the document feeding apparatus 2 as stated above and the feeding speed in a second and following cycles is controlled to a value as high as the processing power (70 cpm) of the reproducing machine 1. Specifically, even if the feeding speed of the document (document exchange speed) in the second and following cycles is set higher and the feeding speed of the copy paper is set similar to the process speed (400 mm/sec) corresponding thereto, the required number of sheets of the copy paper can be fed in the paper feeding path, because the number of copy sheets has been detected in the control means 201 of the reproducing machine 1.

It is also possible to increase the document exchange speed as high as the processing power of the reproducing machine 1 initially in case that the document is circulated twice or more, because the number of sheets of documents can be detected in the first cycle in the control means 201.

In the embodiment thus far described, the documents are set in the laminated state by directing the copy surfaces upward and in the order of pages and by bringing their rear ends into abutment against the rear end regulating member 5 in the home position. Then, the widthwise direction is regulated by the transverse width regulating plates 6 and 6'. After this, the number of copies required is inputted, and the copy button (not-shown) is depressed. The moving position of the transverse width regulating plates 6 and 6' is detected by the position detecting sensor 601 and a detection signal is applied to the control unit 721 of the document feeding apparatus.

When the copy button (not-shown) is turned on, the gate driving source 17 for driving the gate member 7 is energized to lift the gate member 7 to a position, in which the laminated documents can sufficiently advance below the gate member 7.

Next, the chain driving source 72 is started to run the chain 69 forward through the intermediate gear 72' and the sprocket 67 so that the upper end rollers 58 mounted on the upper moving members 65 connected to the upper and lower sides of the chain 69 through the attachments 70 and 71 are moved forward, whereas the lower end rollers 59 mounted on the lower moving members 66 are moved backward. As a result, the rear end regulating plate 5, which is mounted on the upper moving members 65 is advanced while pushing out the rear end of the documents. When the leading end of the documents having passed below the gate member 7 is detected by the stack sensor 27, so that the control unit 721 interrupts the aforementioned chain driving source 72. The document size is detected by the moving amount detecting sensor 501 and the detection signal is applied on the control unit 721 of the document feeding apparatus 2.

The control unit 721 of the document feeding apparatus 2 is operated as follows. The gate driving source 17 is energized to move the gate member 7 downward. At this time, the pin 14 implanted in the shaft 11 turns to be moved far away from the gate lever 12 so that the gate member 7 can always push down the upper surface of the documents by its own weight or by a spring. Since this gate member 7 has its lower edge shaped in comb teeth, it can push the documents onto the paper feeding belt 21 while undulating the documents in cooperation with the ribs 3*a* formed on the upper surface of the document stacker 3.

In the position in which the push-up pin 14 is far apart from the gate lever 12, as has been described hereinbefore, the gate cam gear 16 is rotated by the gate driving source 17 to rock up and down the clutch lever 31, which is retained on the projection 30*b* of the sleeve 30*a* of the one-rotation spring clutch 30, with its cam forming land 16*b* thereby to connect the semicircular rollers 28 and 29 to the main motor 100 so that the push-out belt 20 is run. Then, the documents are pushed out toward the nip between the paper feeding belt 21 and the stop roller 22. Since, at this time, the paper feeding belt 21 is left immobile by the action of the electromagnetic clutch 21*a*, the lower ones of the documents pushed out advance in the form of a wedge into the nip between the paper feeding belt 21 and the stop roller 22.

Next, the electromagnetic clutch 21*a* is turned on to run the paper feeding belt 21 in the paper feeding direction. Since, at this time, the stop roller 22 contacting the paper feeding belt 21 is held immobile, the lowermost one of the documents is fed out by the paper feeding belt 21, whereas a second or subsequent documents are suppressed by the stop roller 22 so that an overlap feed is prevented. During rotations of paper feeding belt 21, the aforementioned push-out belt 20 is synchronously started that only the lowermost document is sucked and separated during one rotation from the laminated documents and is pushed out in the paper feeding direction. In other words, the overlap preventing function of the stop roller is further improved.

One document thus fed out from the paper feeding belt 21 enters the forward passage 35 and is conveyed at a synchronous exposure rate, while being nipped by the conveyor roller 38, to the platen glass plate 36 and the conveyor belt 41. At a timing for each size after the leading end of the document has passed across a synchronous sensor 85 disposed midway of the forward passage 35 (i.e., immediately under the conveyor roller 38), the electro-magnetic clutch 21*a* is turned off.

The document thus conveyed by the aforementioned conveyor roller 38 is exposed by the fixed optical system 54 to form an image on the drum while being conveyed at the synchronous exposure rate on the platen glass plate 36 by the conveyor belt 41.

The control means 201 of the reproducing machine 1 feeds the copy paper from the paper feeding device 216 to the transfer device 214 according to the timing of image formation on the photosensitive drum 211 and at the same time selects one of paper feeding devices 216*a*-216*c* which can feed a copy paper of the size corresponding to the detected values of the position detecting sensor (document width detecting means) 601 of the transverse width regulating plates 6 and 6' on the document stacker and of the moving amount detecting sensor (document length detecting means) 501 of the rear end regulating member 5. In this case, if a copy paper size corresponding to the size detected by the position detecting sensor 601 and a copy paper size corresponding to the size detected by the moving amount detecting sensor 501 of the rear end regulating member 5 are different from each other, the copy paper of larger size is fed.

Thus, the document after being exposure processed is moved along the paper discharge guide plate 55 and discharged to the document stacker 3 by the paper discharging roller 56.

The documents discharged on the document stacker 3 are stacked again after the front and rear ends thereof are regulated by the gate member 7 and the rear end regulating plate 5, and the transverse width thereof is regulated by the transverse width regulating plates 6 and 6'. Accordingly, the paper feeding property in the next paper feeding can be enhanced.

Said feeding operation is repeated until all documents below the gate member are fed while varying the synchronous feeding speed and the feed timing specified by the copy size and copy magnification at every copying operation. When the lack of a document below the gate member is detected by the stack sensor 27 and the discharge of final document is detected by the second paper discharging sensor 86*b*, the gate member 7 is elevated again and the stacked documents are fed out by the rear end regulating plate 5. The above operation is repeated until a predetermined number of copying is completed. In such case, the feeding speed of the document is set as slowly as 40 cpm in case of one sheet copying, even if the processing power of the reproducing machine 1 is 70 cpm. In case of plural sheets copying, however, the feeding speed of the document is set slowly as mentioned above in the first cycle and set as high as the document exchange speed corresponding to the processing power of the reproducing machine 1 in the second and following cycles at which the sheet number of the documents has been detected. When the predetermined number of copying is completed and it is detected by said paper discharging sensor 86*a*, the rear end regulating plate 5 is returned to the home position for the next operation.

The operations described above provide for the case in which one-sided documents are subjected to the one-side copying operation in the RDF mode. As a result, the document stopper 50 disposed at the end portion of the discharge side of the platen glass plate 36 of the reproducing machine 1 sinks below the platen glass plate 36, and the exposing optical system 54 is in the fixed mode at a predetermined position. If the mode is changed to the ADF mode, the exposing optical system 54 is accordingly changed to the moving mode, in which the document stopper 50 disposed at the end portion of the discharge side of the platen glass plate 36 appears from the surface of the platen glass plate to halt the documents at its position (i.e., the exposure position) so that a set number of copies are copied by moving the exposing optical system 54. After this, the documents are conveyed in the discharging direction by the restart of the conveyor belt 41 and the retraction of the document stopper 50 having sunk, until they are discharged through the switching pawl 82 disposed midway of the paper discharge guide plate 55 from the external discharge aperture to the discharge tray 83.

On the other hand, let the case be considered in which one-sided documents are subjected to a two-side copying operation. In this case, the documents set on their stacker are first circulated once while being unexposed so that the number of the documents may be counted and judged whether they are even or odd. This counting operation is accomplished by operating a counter (not shown) through the sensor 85 which is disposed midway of the forward passage 35. If the number is four, for example, the last fourth page of the documents, which have been fed to the platen glass plate 36 from the document feeding apparatus 2, is copied at the reproducing machine body 1 to one side of a transfer paper. Then, the documents are returned to their stacker 3, and the transfer paper having its one side copied is stacked with its copied side facing upward on a transfer paper stacker (not shown) disposed below the photosensitive drum (not shown). The transfer paper having its one side copied is fed, synchronously with the document of the third page fed from the document feeding apparatus 2 onto the platen glass plate, to the photosensitive drum from its stacker with its uncopied side facing upward, until the third page is copied and discharged. This is repeated likewise for the second and first pages. If the documents have three pages, the last third page is copied and discharged instantly. The transfer paper having copied the second page is fed to the transfer paper stacker, from which is fed the first page until it is copied and discharged.

In the case two-sided documents are subjected to a one-side copying operation, on the other hand, the documents sent out from their stacker are fed through the forward passage 35 onto the platen glass plate 36. Then, the last page is on the top of the documents on the platen glass plate 36. (1) The document once fed onto the platen glass plate 36 is halted at the timing when its trailing end rides on the glass plate. (2) The conveyor belt 41 is reversed to feed the document to the turning passage 37 thereby to turn the document upside down. The documents are exposed on the platen glass plate 36 by the fixed optical system 54 with the last page being in the lowermost position. In synchronism with this, the transfer paper fed from the paper feeding unit of the reproducing machine body 1 is copied and discharged as it is. (3) The exposed documents are fed again by reversing the conveyor belt 41 so that their page order may be corrected through the turning passage 37. The documents are exposed on the platen glass plate 36 with their other pages facing downward and are copied to the subsequent transfer paper fed from the paper feeding unit of the reproducing machine body 1. After this, the documents are returned to their stacker 3. The one-side copying operations of the two-sided documents are completed by repeating the above-specified operations (1) to (3).

In the case the two-sided documents are subjected to a two-side copying operation, on the other hand, only the even-numbered pages are first copied. Specifically, after the documents have been fed to the platen glass plate, they are turned through the turning passage 37 so that each of the even pages is exposed, while being directed downward, and copied to one-side of transfer paper. After this, the documents are returned again through the turning passage 37 to their stacker 3, while being left unexposed, whereas the one-side copied transfer paper is stacked on its stacker in the reproducing machine body 1. After all the even-numbered pages have been thus copied, the copying operations of odd-numbered pages are started. For these copying operations of the odd-numbered pages, the turning operations of the documents are not required, and the transfer paper is sent out from its stacker so that the other sides of the one-side copied transfer paper is copied. Specifically, the third page is copied on the other side of the transfer paper copied with the fourth page, and the first page is copied on the other side of the transfer paper with the second page.

EFFECT OF THE INVENTION

As has been explained, the present invention is characterized by control means for changing the feeding speed of a document in a reproducing machine having a document feeding apparatus wherein the document on a document stacker can be fed repeatedly after it is returned through a paper feeding portion and a processing portion to the document stacker, so that a high document exchanging speed can be obtained while utilizing a sufficient amount of the processing power of the reproducing machine without allowing any copy paper to remain in the paper feeding path.

What is claimed is:

1. In a reproducing machine with a document feeding apparatus wherein a document on a document stacker can be fed repeatedly after it is returned to the document stacker through a document feeding portion and a processing portion, the improvement characterized in that control means for varying a feeding speed of the document is provided, said control means operating so that the feeding speed of the document when a single copy is required and the feeding speed of the document in a first cycle of copying when plural copies are required are set slower than that of the document in following cycles when plural copies are required.

2. A reproducing machine wherein images on documents are copied on copy sheets comprising:

a document stacker for receiving a document having an original image thereon;

an exposure processing portion wherein said original image on said document is scanned to provide a recorded image for a copy sheet;

means for repeatedly feeding said document along a path from said document stacker, through said exposure processing portion for scanning said original image thereon and back to said document stacker;

first control mean for selectively varying the feeding speed of said document along said path;

and means for feeding a copy sheet through a copy cycle of predetermined duration during which a recorded image is provided thereon;

wherein said first control means operates so that:

when a single copy sheet is to be fed, the feeding speed of said document is at a predetermined speed;

and when a plurality of copy sheets are to be fed, the feeding speed of said document is at said predetermined speed for a first copy cycle and the feeding speed of said document is at a speed greater than said predetermined speed for each copy cycle subsequent to said first copy cycle.

3. A reproducing machine wherein one or more copies of a document are to be produced comprising:

a processing portion wherein said document is processed to provide for production of a copy thereof;

means for repeatedly feeding said document to said processing portion;

and control means for varying the feeding speed of said document in accordance with the number of copies thereof to be processed;

wherein said control means operates to feed said document at a predetermined speed when a single copy is to be produced and, when a plurality of copies are to be produced, operates to feed said document at said predetermined speed for the first copy of said plurality of copies to be produced and to feed said document at a speed greater than said predetermined speed for the subsequent copies of said plurality of copies to be produced.

* * * * *